United States Patent [19]

Allen

[11] Patent Number: 5,028,023

[45] Date of Patent: Jul. 2, 1991

[54] DEVICE FOR HOLDING A CONTAINER UPRIGHT

[76] Inventor: William M. Allen, 204 Cayuga Rd., Louisville, Ky. 40207

[21] Appl. No.: 328,900

[22] Filed: Mar. 27, 1989

[51] Int. Cl.[5] ..... A47G 23/00

[52] U.S. Cl. ..... 248/152; 248/346.1; 248/174; 206/423

[58] Field of Search ..... 248/152, 346.1, 150, 248/174, 311.2, 146; 206/423, 486, 485, 490, 477, 479

[56] References Cited

U.S. PATENT DOCUMENTS

| | | | |
|---|---|---|---|
| 1,638,480 | 8/1927 | Feybusch | 206/485 X |
| 2,301,216 | 11/1942 | Koontz | 248/152 X |
| 3,297,289 | 1/1967 | LaRaus | 248/152 |
| 3,481,075 | 12/1969 | Dastoli et al. | 206/423 X |
| 3,881,674 | 5/1975 | Greene, III | 248/152 |
| 4,248,347 | 2/1981 | Trimbee | 206/423 |
| 4,678,149 | 7/1987 | Chase | 248/152 X |
| 4,681,224 | 7/1987 | Niemann | 248/152 X |

FOREIGN PATENT DOCUMENTS

| | | | |
|---|---|---|---|
| 231167 | 5/1944 | Switzerland | 206/423 |
| 660448 | 4/1987 | Switzerland | 248/311.2 |

*Primary Examiner*—Karen J. Chotkowski

*Attorney, Agent, or Firm*—Jon C. Winger

[57] ABSTRACT

A device for holding a container in an upright position includes a base panel upon which the container rests and container anchoring portions interconnected to the base panel which surround the container above the base panel to hold the container in place on the base panel.

13 Claims, 5 Drawing Sheets

DEVICE FOR HOLDING A CONTAINER UPRIGHT

BACKGROUND OF THE INVENTION

The present invention relates to holders for containers for flowers and plants such as flower vases and pots which is particularly useful for supporting these containers during transportation from one place to another.

Florists sell flowers and plants both directly to customers so that the customers can take their purchase with them, and also deliver the flowers and plants to wherever the customer designates.

The problem is that during transportation, either by the customer or florist, it often happens that the flower vase or pot easily tips over spilling the contents.

One known attempted solution to this problem is to place the containers in a box. However, boxes are not specially designed for the purpose of transporting such containers and do not hold the container upright. The containers can and do still fall over and the contents are spilled inside the box. Furthermore, boxes take up substantial volume and, therefore, present a storage problem because they occupy valuable space in the florist's business facility.

Another problem also exists at the destination of the containers, such as hospitals, which receive many containers of flowers and plants for patients which must then be delivered to the various patients. This is often done on push carts and the containers are easily tipped over spilling the contents which must be cleaned up.

Various other solutions have been proposed. Examples of these proposed solutions are shown in U.S. Pat. No. 2,063,328 issued on Dec. 8, 1936; U.S. Pat. No. 2,784,577 issued on Mar. 12, 1957; U.S. Pat. No. 2,980,377 issued on Apr. 18, 1961; U.S. Pat. No. 3,297,289 issued on Jan. 10, 1967; and U.S. Pat. No. 4,726,553 issued on Feb. 23, 1988.

However, each of these proposed solutions has itself major drawbacks. For example, each of these proposals is of a fixed size and accept only one size container. This drawback requires an inventory of such holders of various sizes.

A further drawback of the containers shown in U.S. Pat. No. 2,784,577; U.S. Pat. No. 2,980,377; and U.S. Pat. No. 4,726,553 is that they are of a physical configuration which requires a substantial space when stored.

SUMMARY OF THE INVENTION

An object of the present invention is to provide a device for holding a container upright which is adaptable to hold containers of various sizes thereby reducing or eliminating the requirement for inventoring holders of various sizes.

It is another object of the present invention which, when not used to hold containers, is substantially flat or planar for compact storage thereby freeing up room otherwise required for storage.

It is a further object of the present invention to provide a holder which is of straightforward construction and, therefore, inexpensive to purchase, so that a vendor of the flowers or other contents of the containers can afford to give them away with the purchase of the flowers as a service to the purchaser.

It is yet another object of the present invention to provide a container holding device which mechanically, positively engages the container to hold the container downwardly against the base of the container holding device.

BRIEF DESCRIPTION OF THE DRAWINGS

A better understanding of the invention will be had upon reference to the following description in conjunction with the accompanying drawings wherein like numerals refer to like parts through the several views and in which.

DETAILED DESCRIPTION OF THE ADVANTAGEOUS EMBODIMENTS

Figure 1:
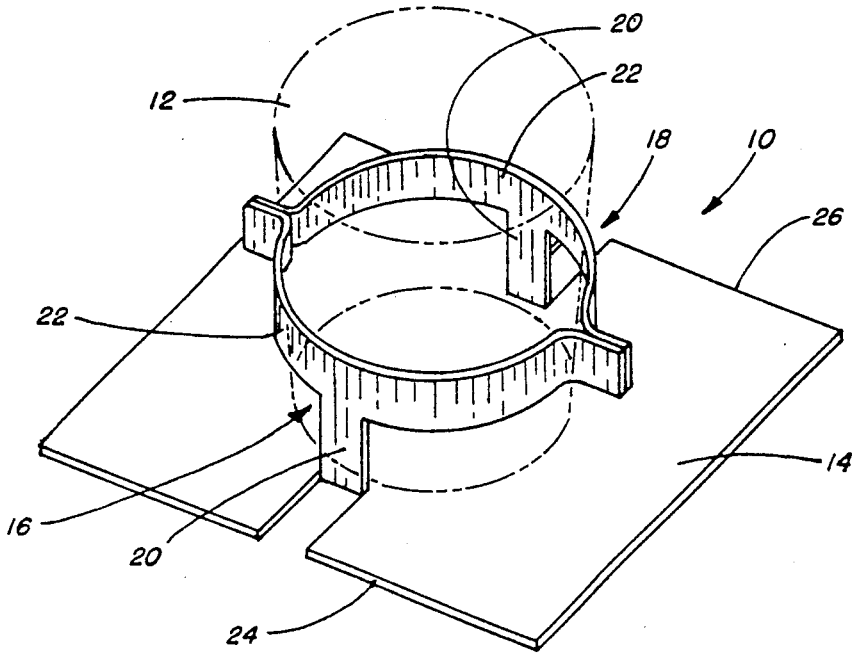
FIG. 1 shows a perspective view of an advantageous embodiment of a container holder of the present invention holding a container such as a flower pot or vase.
Figure 2:
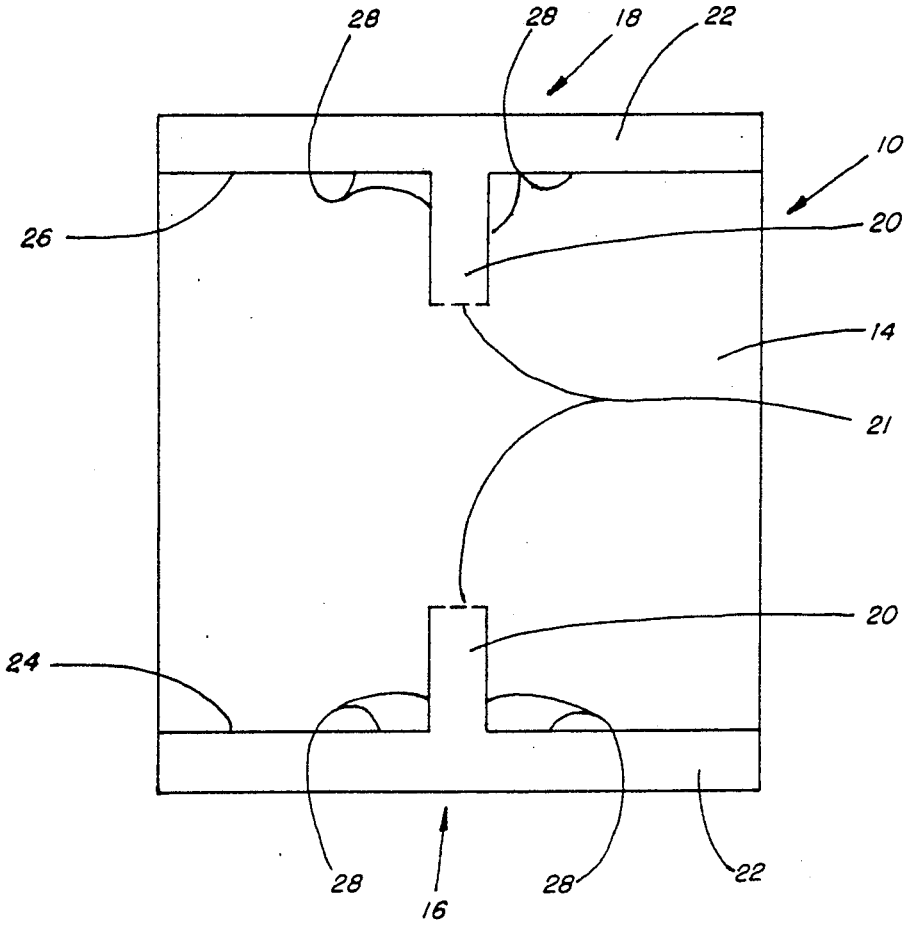
FIG. 2 shows a plan view of the holder of FIG. 1 in its unfolded configuration suitable for storage.

With reference to FIGS. 1 and 2, there is shown a device, generally denoted as the numeral 10, for holding a container 12 (shown in phantom lines) such as, for example, a flower vase or pot, upright.

The holder device 10 includes a base panel 14 upon which the base of the container 12 rests. As shown, the base panel 14 is preferably rectangular in peripheral configuration although it is conceivable that other peripheral configurations can be used. The holder device 10 further includes two anchoring flanges 16 and 18 disposed to opposite sides of the base panel 14 and in alignment with each other. The anchoring flanges 16, 18 are each Tee-shaped with the stem 20 integrally connected at its bottom or proximal end to the base panel 14 and the arms 22 extending outwardly from the top or distal end of the stem 20. The Tee-shaped anchoring flanges 16 and 18 are foldable relative to the base panel 14 about the integral interface of the stem 20 with the base panel 14. A score or crease line 21 can be formed transversely of the stem 20 so that the stem 20 can be easily folded about the score line 21.

As can be seen in FIG. 2, when in a preassembled state or prior to assembly not in use supporting a container 12, the holder 10 is unfolded and in a planar configuration. In the unfolded configuration, the Tee-shaped anchoring flanges 16 and 18 are coplanar with the base panel 14. The arms 22 of the two anchoring flanges 16 and 18 extend along opposite side edges 24 and 26 of the base panel 14, and the stems 20 of the two anchoring flanges 16 and 18 extend inwardly of the base panel 14 perpendicularly from the opposite base panel side edges 24 and 26 in coaxial alignment with each other.

As can be best visualized in FIG. 2, it is contemplated that the holder device 10 be fabricated from a single blank of material, such as paperboard, corrugated board, or other suitably stiff material. Preferably, the material of the holder 10 is of the type which is at least somewhat absorbent, but will not disintegrate when wet. The Tee-shaped anchoring flanges 16 and 18 are cut in the material blank along cut lines 28 which define the peripheral configuration of the two Tee-shaped flanges 16 and 18 and sever the Tee-shaped flanges 16 and 18 from the material blank.

With reference to FIGS. 1 and 2, in an assembled state holding container upright, the container 12 is positioned with its bottom or base resting on the base panel 14 between the proximal ends of the stem 20 of the two anchoring flanges 16 and 18. The two anchoring flanges 16 and 18 are folded about the interface of their respective stems 20 with the base panel 14 so that the stems 20 extend upwardly along opposite sides of the container 12 with the arms 22 extending transversely of the container in registration with each other. The free or distal ends of the arm 22 of the anchoring flange 16 are then brought together in overlapping relationship with and attached to the adjacent free or distal ends of the arm 22 of the other anchoring flange 18 thereby forming a collar surrounding the container 12. The distal ends of the arms 22 of the anchoring flanges 16 and 18 can be fastened together by virtually any convenient fastener means such as, for example, taping them together or stapling them together. Preferably, the collar formed by the arms 22 of the anchoring flanges 16 and 18 tightly encompasses the container 12.

The anchoring flanges 16, 18 can be easily modified by the user to support short containers by merely folding the extending arms 22 back over the stem 20 transversely of the stem 20 thereby effectively shortening the length of the stem 20. Alternatively, it is contemplated that the cut lines 28 defining the opposite longitudinal sides of the stem 20 are not continuous along the entire length of the stem 20 thereby leaving webs of uncut material at preselected intervals along the length of the stem 20. Thus, the user can select the length of the stem 20 to suit the height of a particular container by severing the stem 20 from the bank to a location of the webs corresponding to a stem length which will position the arms 22 of the anchoring flanges 16, 18 beneath the top end of the container to be held in position on the container holding device 10.

It should be noted that when the holder 10 is in the unfolded flat configuration shown in FIG. 2, that a plurality of holders 10 can be placed in a stack which requires very little storage space.

The holder device 10 can be made in a single size which will function to hold containers 12 of many various circumferential dimensions and shapes as well as containers 12 of different heights. This versatility is provided for by the feature that the distal adjacent ends of the arms 22 of the anchoring flanges 16 and 18 can be overlapped with each other to a greater or lesser extent before they are fastened together thereby defining a collar of a suitable perimeter dimension to encompass different circumferentially sized containers 12.

Figure 3:
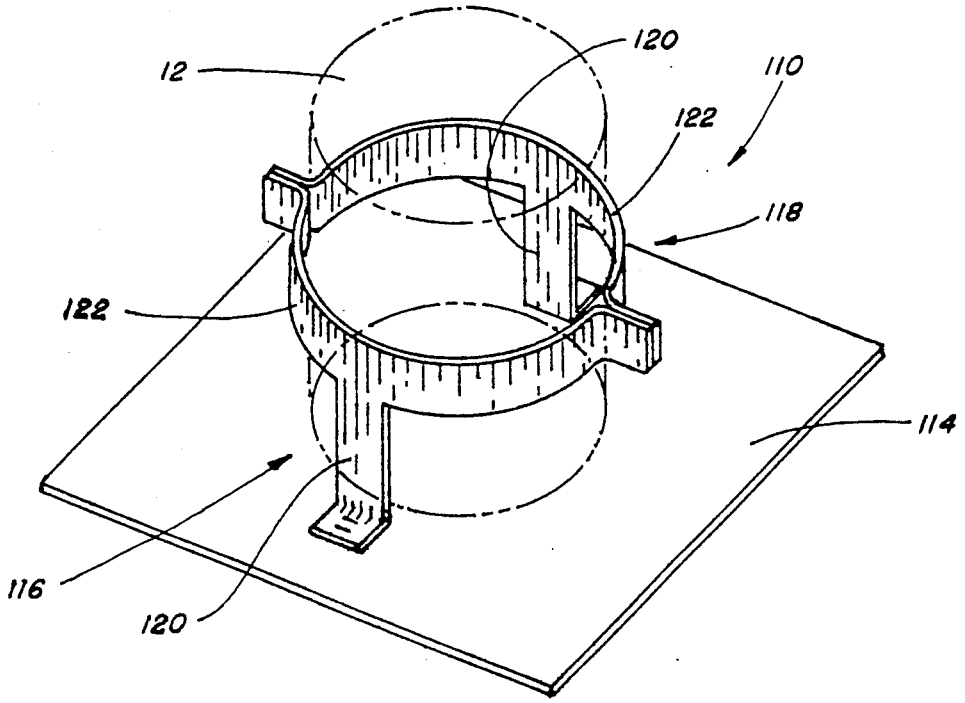
FIG. 3 shows a perspective view of another advantageous embodiment of a container holder of the present invention.
Figure 4:
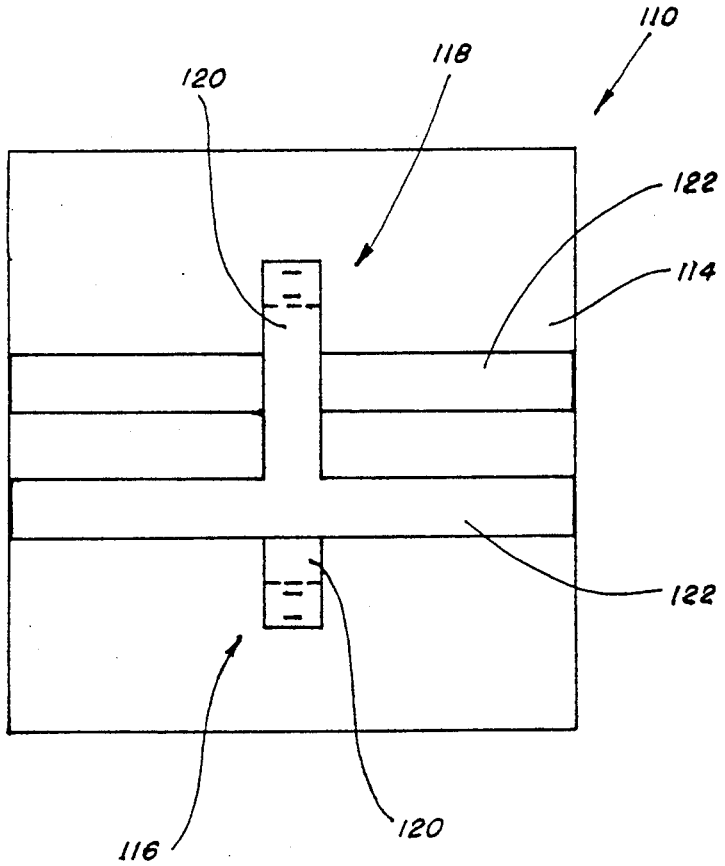
FIG. 4 shows a plan view of the holder of FIG. 3 in its unfolded configuration suitable for storage.

With reference to FIGS. 3 and 4, there is shown a container holder 110 for holding the container 12 upright which has many features in common with the container holder 10 of FIGS. 1 and 2. The holder 110 includes a base panel 114 upon which the base of the container 12 rests. The holder 110 includes two oppositely disposed spaced apart anchoring flanges 116 and 118. The anchoring flanges 116 and 118 are each Tee-shaped with the stem 120 fastened at its bottom or proximal end to the base panel 114 and the arms 122 extending outwardly from the top or distal end of the stem 120. The Tee-shaped anchoring flanges 116 and 118 are separate components from the base panel 114 and are fastened thereto by fastener means such as tape or staples. The Tee-shaped anchoring flanges 116 and 118 are foldable relative to the base panel 114 about the end of the stem 120 attached to the base panel 114.

As can be seen in FIG. 4, when in an assembled state holding not in use supporting a container 12, Tee-shaped anchoring flanges 16 and 18 are positioned in overlaying relationship to the top surface of the base panel 114, and as shown, in overlapping relationship to each other.

With reference to FIGS. 3 and 4, in an assembled state holding a container upright, the two Tee-shaped anchoring flanges 116 and 118 are folded upwardly away from the base panel 114 about the proximal ends of the stems 120 attached to the base panel 114, and the container 12 is positioned with its bottom or base resting on the base panel 114 between the proximal ends of the stems 120 of the two anchoring flanges 116 and 118. Thus, the stems 120 extend upwardly along opposite sides of the container 12 with the arms 122 extending transversely of the container 12 in registration with each other. The free or distal ends of the arm 122 of the anchoring flange 116 are then brought together in overlapping relationship and attached to the adjacent free or distal ends of the arm 122 of the other anchoring flange 118 thereby forming a collar surrounding the container 12. The free or distal ends of the arms 122 of the anchoring flanges 116 and 118 can be fastened together by virtually any convenient fastener means such as, for example, taping them together or stapling them together.

Figure 5:
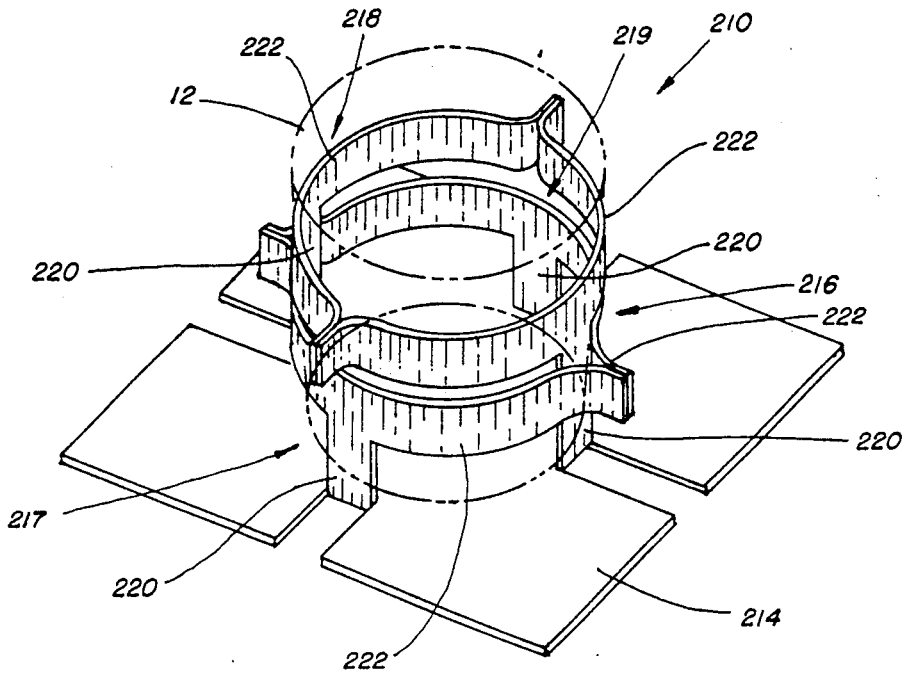
FIG. 5 shows a perspective view of yet another advantageous embodiment of a container holder of the present invention.
Figure 6:
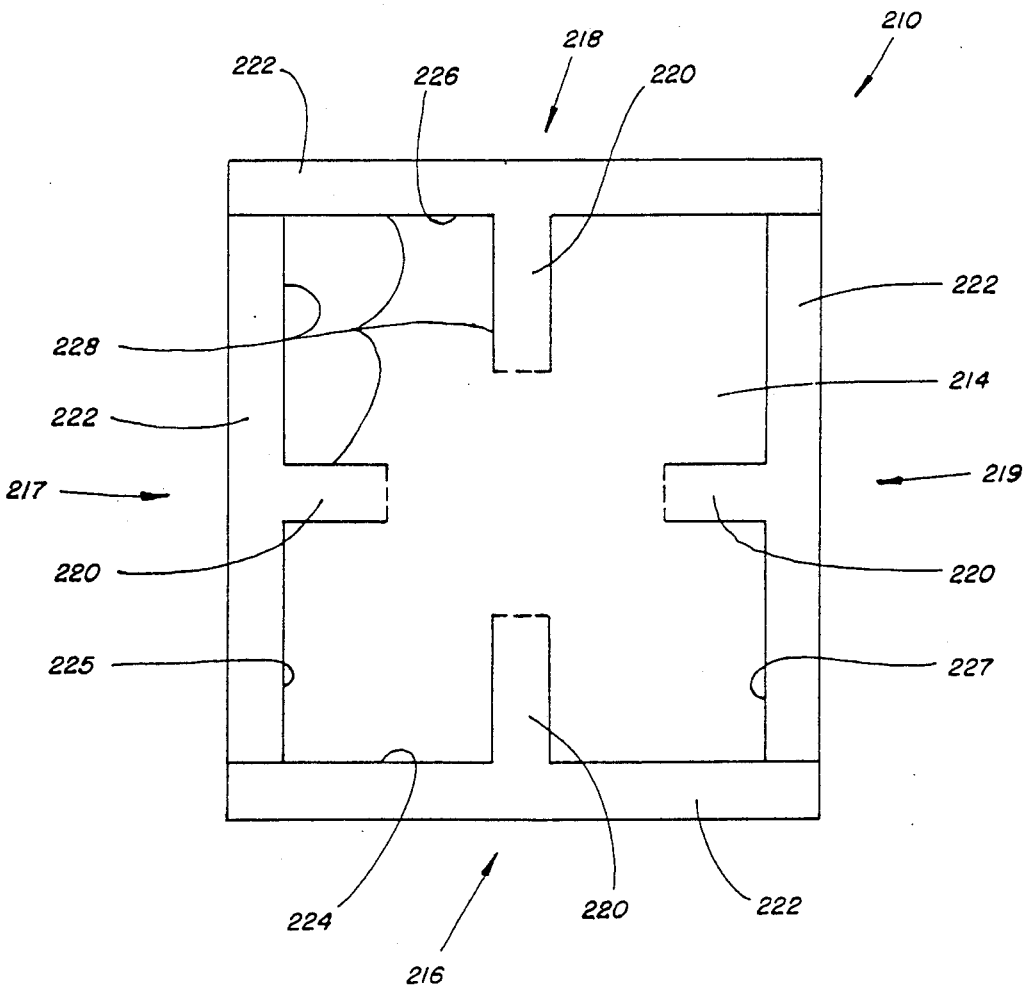
FIG. 6 shows a plan view of holder of FIG. 5 in its unfolded configuration suitable for storage.

With reference to FIGS. 5 and 6, there is shown a device, generally denoted as the numeral 210, for holding a container 12 such as, for example, a flower pot or vase in an upright position which is similar in many respects to the container holder 10 of FIGS. 1 and 2.

The holder 220 includes a base panel 214 upon which the base of the container 12 rests. As shown, the base panel 214 is preferably rectangular in peripheral configuration. The holder device 220 further includes four anchoring flanges 216, 217, 218, and 219 disposed in facing pairs with the flanges 216 and 218 of one pair located to opposite sides of the base panel 214 and in alignment with each other, and the flanges 217 and 219 of the other pair located to the other opposite sides of the base panel 214 and in alignment with each other. The anchoring flanges 216, 217, 218 and 219 are each Tee-shaped with the stem 220 integrally connected at its bottom or proximal end to the base panel 214 and the arms 222 extending outwardly from the top or distal end of the stem 220. The Tee-shaped anchoring flanges 216, 217, 218, 219 are foldable relative to the base panel 214 about the integral interface with the base panel 214. The Tee-shaped anchoring flanges 217 and 219 are identical to each other in size as well as shape, and the flanges 216 and 218 are identical to each in size as well as shape. However, the stems 220 of the anchoring flanges 217 and 219 are shorter than are the stems 220 of the anchoring flanges 216 and 218 for reasons which will become apparent hereinafter.

As can be best seen in FIG. 6, when in a preassembled state or prior to assembly not in use supporting a container 12, the holder 210 is unfolded and in a planar configuration. In the unfolded configuration, the Tee-shaped anchoring flanges 216, 217, 218, and 219 are coplanar with the base panel 214. The arms 222 of the four anchoring flanges 216, 217, 218, and 219 extend along a different one of the side edges of the base panel 214, with the stems 220 of the two opposite anchoring flanges 216 and 218 extending inwardly of the base panel 214 from the opposite base panel side edges 224 and 226 in coaxial alignment with each other, and the stems 220 of the other two opposite anchoring flanges 217 and 219 extending inwardly of the base panel 214 from the other two opposite base panel side edges 225 and 227 in coaxial relationship with each other.

It is contemplated that the holder 210 be fabricated from a single blank of material with the anchoring flanges cut in the blank along cut lines 228 which define the peripheral configuration of the Tee-shaped flanges 216, 217, 218, and 219 and sever them from the blank except for the integral connection of the stems 220 of the base panel 214.

With reference to FIGS. 5 and 6, in an assembled state holding the container upright, the container 12 is positioned with its bottom or base resting on the base panel 214 between the proximal ends of the stems 220 of the four anchoring flanges 216, 217, 218, and 219 and one or the other of the pair of anchoring flanges 216, 218 or pair of anchoring flanges 217, 219 are used to hold the container 12. The stems 220 of a selected pair of anchoring flanges 216, 218 or 217, 219 are folded about the interface of their respective stems 220 with the base panel 214 so that the stems 220 extend upwardly along opposite sides of the container 12 with the arms 222 thereof extending transversely of the container in registration with each other. The free or distal ends of the arms 222 of the anchoring flanges 216 and 218 or flanges 217 and 219 are then brought together in overlapping relationship and attached to the adjacent free or distal ends of the arm 222 of the other anchoring flange thereby forming a collar surrounding the container 12. The pair of anchoring flanges 216, 218 or 217, 219 to be used is dictated by the height of the container 12. The pair of anchoring flanges 216, 218 having a longer stem 220 than the other pair of anchoring flanges 217, 219 are used to hold taller containers 12 and the pair of anchoring flanges 217, 219 are used to hold shorter containers 12.

As with the holder 10, when the holder 210 is in the unfolded flat configuration shown in FIG. 6, that a plurality of holders 210 can be placed in a stack requiring very little storage space.

Figure 7:
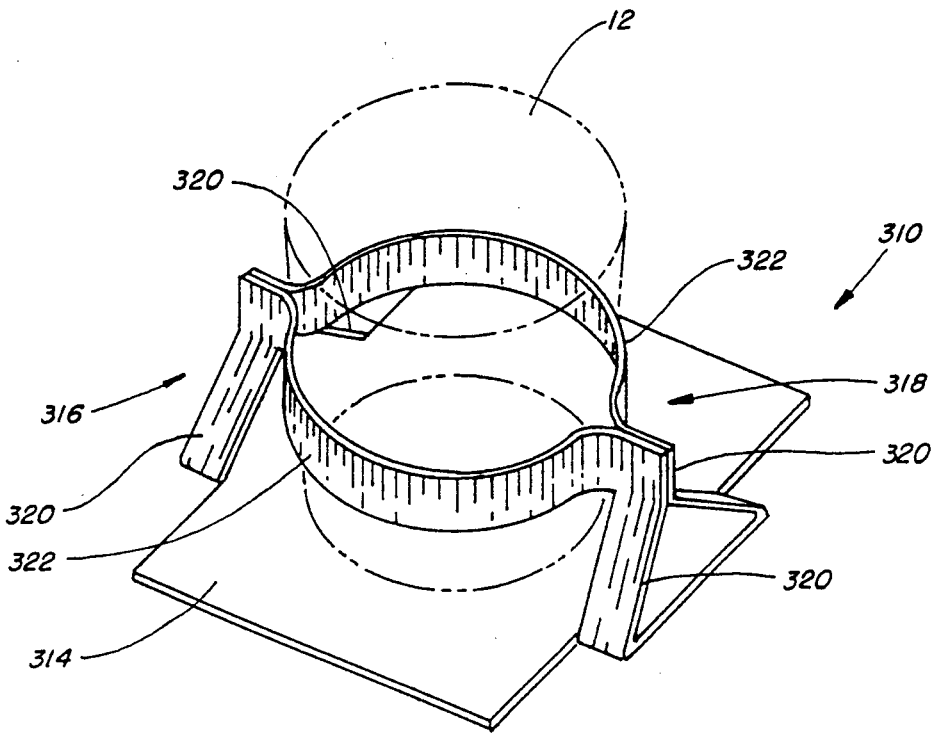
FIG. 7 shows a perspective view of still another advantageous embodiment of a container holder of the present invention.
Figure 8:
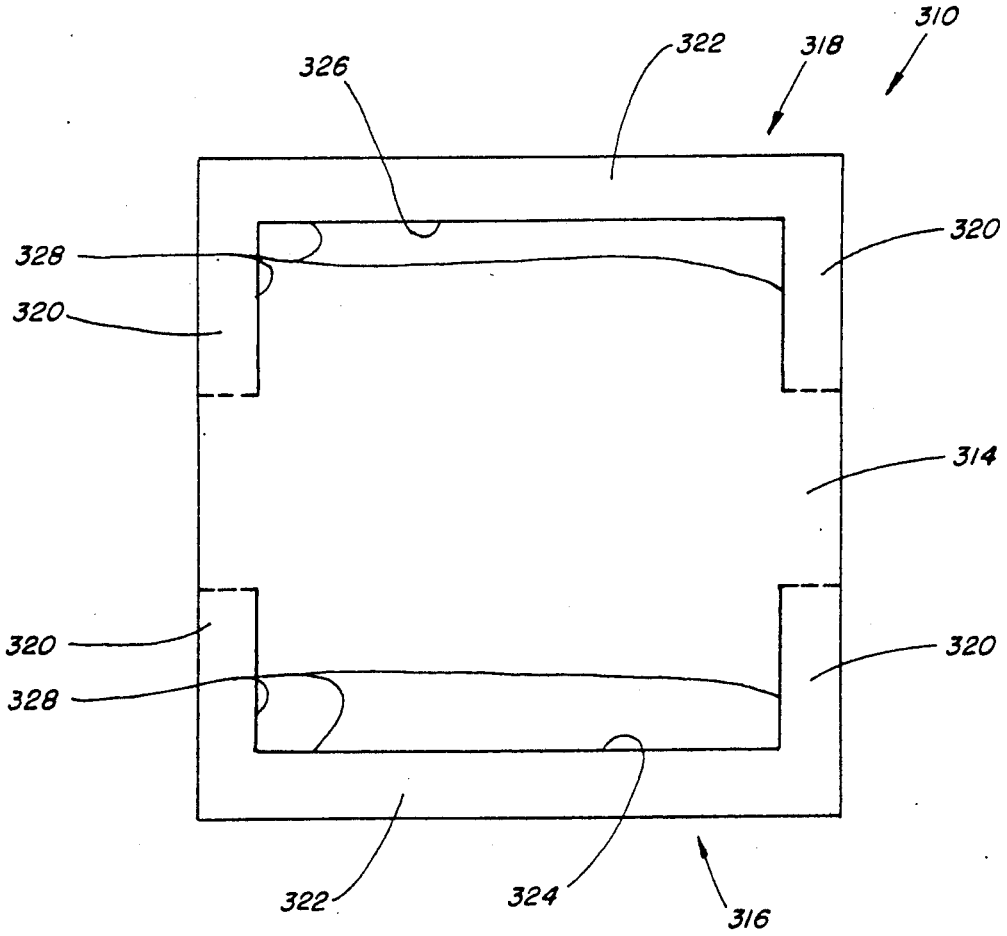
FIG. 8 shows a plan view of the holder of FIG. 7 in its unfolded configuration suitable for storage.

Now with reference to FIGS. 7 and 8, there is shown a device, generally denoted as the numeral 310, for holding a container 12 such as for example, a flower vase or pot which is similar in many respect to the holder 10 of FIGS. 1 and 2.

The holder 310 includes a base panel 314 upon which the base of the container 12 rests. As shown, the base panel 314 is preferably rectangular in peripheral configuration. The holder device 310 further includes two anchoring flanges 316 and 318 disposed to opposite sides of the base panel 314 and in alignment with each other. The anchoring flanges 316 and 318 each include two parallel, spaced apart stems 320 integrally connected at their bottom or proximal ends to the base panel 314, and an arm 322 extending between and integrally connected at its opposite ends to the top or distal ends of the stems 320. The anchoring flanges 316 and 318 are foldable relative to the base panel 314 about the integral interface of the stems 320 with the base panel 314.

As can be best seen in FIG. 8, when in a preassembled state or prior to assembly not in use supporting the container 12, the holder 310 is unfolded in a planar configuration. In the unfolded configuration, the anchoring flanges 316 and 318 are coplanar with the base panel 314. The arms 322 of the two anchoring flanges 314 and 316 extend along opposite side edges 324 and 326 of the base panel 314, and the stems 320 of the two anchoring flanges 316 and 318 extend perpendicularly from the opposite base panel side edges 324 and 326 in coaxial alignment with each other.

It is contemplated that the holder device 310 be fabricated from a single blank of material, such as paperboard or corrugated board, which is suitably stiff and somewhat absorbent but will not disintegrate when wet. The anchoring flanges 316 and 318 are then cut in the material blank along cut lines 328 which define the perimeter configuration of the two anchoring flanges 316 and 318 and sever the anchoring flanges 316 and 318 from the material blank.

With reference to FIGS. 7 and 8, in an assembled state holding a container upright, the container 12 is positioned with its bottom or base resting on the base panel 314 between the two anchoring flanges 316 and 318. The two anchoring flanges 316 and 318 are then folded about the interface of their stems 320 with the base panel 314 so that the arms 322 extend transversely of the container 12 on opposite sides of the container 12 in registration with each other. The ends of the arms 322 of the anchoring flange 316 are then brought together in overlapping relationship with and attached to adjacent ends of the arm 322 of the other anchoring flange 318 thereby forming a collar surrounding the container 12. Preferably, the collar formed by the arms 322 of the anchoring flanges 316 and 318 tightly encompasses the container 12.

The holder device 310 can be made in a single size which will function to hold containers 12 of many various circumferential dimensions and shapes. The versatility is provided for by the feature that the adjacent ends of the arms 322 of the anchoring flanges 316 and 318 can be overlapped with each other to a greater or lesser extent before they are fastened together thereby defining a collar of a suitable perimeter dimension to encompass different circumferentially sized containers 12.

Figure 9:
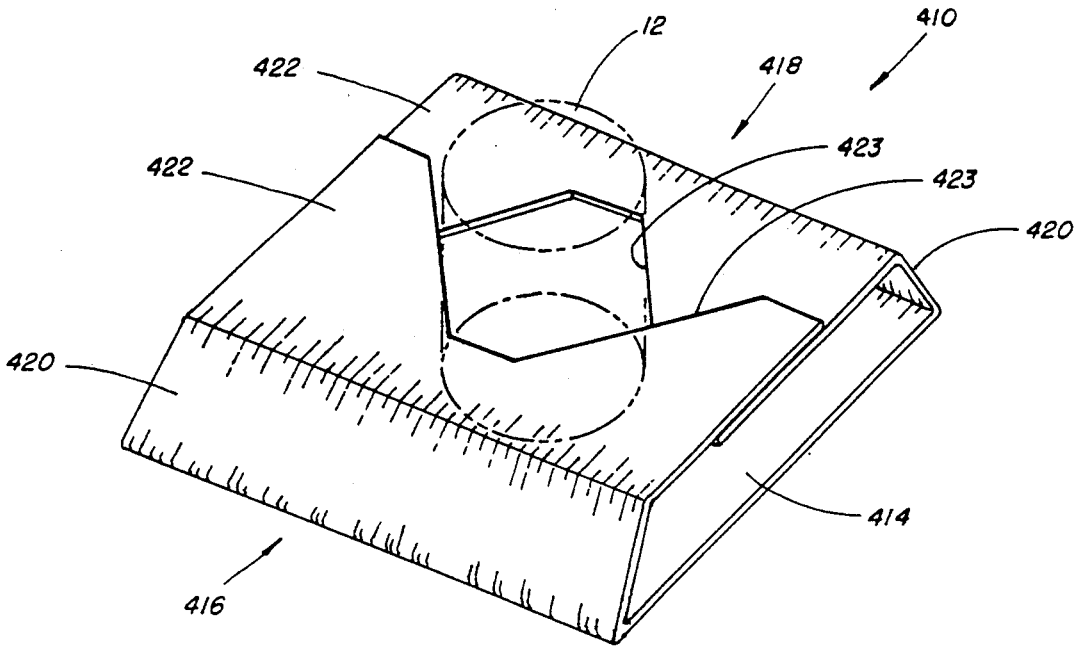
FIG. 9 is a perspective view of yet another advantageous embodiment of a container holder of the present invention.
Figure 10:
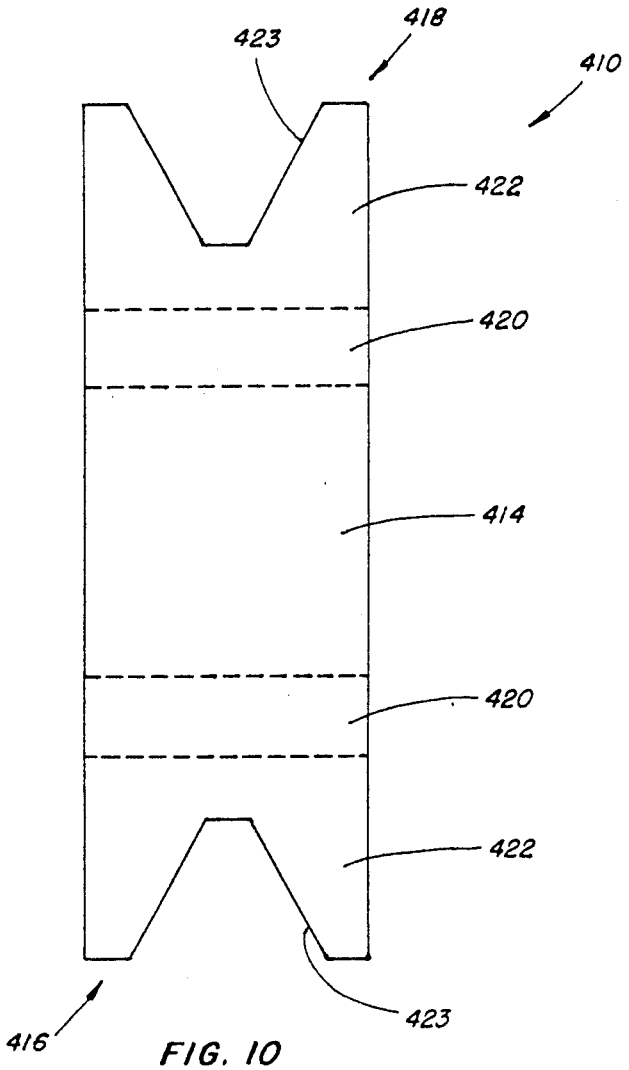
FIG. 10 shows a plan view of the holder of FIG. 9 in its unfolded configuration suitable for storage.

FIGS. 9 and 10, there is shown a device, generally denoted as the numeral 410, for holding a container 12 such as, for example, a flower vase or pot, upright.

The holder 410 includes a base panel 414 upon which the base of the container 12 rests. As shown, the base panel 414 is preferably rectangular in peripheral configuration. The holder 410 further includes two anchoring flanges 416 and 418 disposed to opposite sides of the base panel 414 and in alignment with each other. Each anchoring flange 416 and 418 includes a stem panel 420 integrally attached at its bottom or proximal end to an edge of the base panel 414. The stem panel 420 is foldable about the integral interface of the stem panel 420 with the base panel 414. A crease line or score line can be formed at the interface of the stems 420 and base panel 414 to provide a straight fold. Each anchoring flange 416 and 418 also includes an arm panel 422 attached at its proximal end to the top or distal end of the stem panel 420. The arm panel 422 is foldable about the integral interface of the arm panel 422 with the stem panel 420. A crease line or score line can be formed at the sinterface of the arm panels 422 and stem panels 420 to provide a straight fold. The distal end of the arm panel 420 of each anchoring flange 416 and 418 is formed with a concave configuration 423. As shown, the concave configuration 423 is generally V-shaped. However, it is contemplated that various geometric configurations, such as a semi-circular shape, will also function satisfactorially.

As can be seen in FIG. 10, when not in use supporting a container 12, the holder 410 is unfolded and in a planar configuration.

It is contemplated that the holder device 410 be fabricated from a single blank of material, such as paperboard, corrugated board, or other suitably stiff material. Preferably, the material of the holder device 410 is of the type which is at least somewhat absorbent but will not disintegrate when wet.

With reference to FIGS. 9 and 10, in order to hold a container 12 upright, the container 12 is positioned with its bottom or base resting on the base panel 414 between the stem panels 420 of the two anchoring flanges 416 and 418. The stem panels 420 are each folded about their interface with the base panel 414 so that the stem panels 420 extend upwardly to opposite sides of the container 12. And, the arm panels 422 are each folded about their interface with the distal end of the stem panels 420 to extend from the distal ends of the stem panels 420 transversely of the container 12 toward each other with the free or distal ends of the arm panels 422 brought together in overlapping relationship with each other, and are attached together so that the concave configurations 423 cooperate to form a collar surrounding the container 12. Preferably, the collar formed by the concave configurations 423 tightly encompasses the container 12.

It should be noted that when the holder device 410 is in the unfolded flat configuration shown in FIG. 10, that a plurality of the holder devices 410 can be placed in a stack and require little storage space.

The holder device 410 can be made in a single size which will function to hold containers 12 of many various circumferential dimensions and shapes as well as containers 12 of different heights. This versatility is provided for by the feature that the distal ends of the arm panels 422 of the anchoring flanges 416 and 418 can be overlapped to a greater or lesser extent before they are fastened together thereby causing the concave configurations 423 to cooperate to define a collar of a suitable perimeter dimension to encompass different circumferentially sized containers 12.

The foregoing detailed description is given primarily for clearness of understanding and no unnecessary limitations are to be understood therefrom for modifications will become obvious to those skilled in the art and may be made without departing from the spirit of the invention and scope of the appended claims.

I claim:

1. A device for holding a container upright, the device when in a preassembled state, comprising:

a base panel upon which the bottom of the container to be held will rest;

a first pair of Tee-shaped anchoring flanges, each Tee-shaped anchoring flange of the first pair having a stem integrally connected at a proximal end of the stem to the base panel and an arm integral with and extending outwardly from a distal end of the stem, the Tee-shaped anchoring flanges being coplanar with the base panel with the arms of the two anchoring flanges being adjacent to and extending along opposite sides of the base panel and the stems of the two anchoring flanges of the first pair of anchoring flanges extending inwardly of the base panel from the arms of the anchoring flanges.

2. The device of claim 1, wherein the stems of the two anchoring flanges of the first pair of anchoring flanges are in coaxial alignment with each other.

3. The device of claim 1, wherein the arms of the two anchoring flanges of the first pair of anchoring flanges are coextensive with an adjacent side of the base panel.

4. The device of claim 1, wherein the base panel has a generally rectangular peripheral configuration.

5. The device of claim 1, further comprising a second pair of Tee-shaped anchoring flanges, each Tee-shaped anchoring flange of a second pair having a stem integrally connected at the proximal end of the stem to the base panel and an arm integral with and extending outwardly from a distal end of the stem, the Tee-shaped anchoring flanges of the second pair of anchoring flanges being co-planar with the base panel with the arms of the two anchoring flanges of the second pair of anchoring flanges adjacent to and extending along opposite sides of the base panel and the stems of the two anchoring flanges of the second pair of anchoring flanges extending inwardly of the base panel from the arms of the anchoring flanges of the second pair of anchoring flanges generally perpendicular to the stems of the first pair of anchoring flanges.

6. The device of claim 5, wherein the stems of the two anchoring flanges of the first pair of anchoring flanges are in coaxial alignment with each other, and the stems of the two anchoring flanges of the second pair of anchoring flanges are in coaxial alignment with each other.

7. The device of claim 5, wherein the arms of the two anchoring flanges of the first pair of anchoring flanges are co-extensive with the adjacent side of an base panel, and the arms of the two anchoring flanges of the second pair of anchoring flanges are co-extensive with an adjacent side of the base panel.

8. The device of claim 5, wherein the base panel has a generally rectangular peripheral configuration.

9. The device of claim 5, wherein the stems of the second pair of Tee-shaped anchoring flanges are shorter than the stems of the first pair of Tee-shaped anchoring flanges.

10. A device for holding a container upright, the device when in a preassembled state comprising:

a base panel upon which the bottom of the container to be held will rest;

two anchoring flanges disposed to opposite sides of the base panel, each anchoring flange having two parallel, spaced-apart stems and an arm integral with and extending between a distal end of the stems, each stem being integrally connected at a proximal end of the stem to the base panel, the anchoring flanges being coplanar with the base panel with the arms of the two anchoring flanges adjacent to and extending along opposite side edges of the base panel, and the stems of each of the two anchoring flanges extending inwardly of the base panel from the arms of the anchoring flanges.

11. The device of claim 10, wherein the stems of one of the two anchoring flanges are each in coaxial alignment with a different one of the stems of the other one of the two anchoring flanges.

12. The device of claim 10, wherein arms of the two anchoring flanges are coextensive with an adjacent sides of the base panel.

13. The device of claim 10, wherein the base panel has a generally rectangular peripheral configuration.

* * * * *